US007975353B2

(12) United States Patent
Leger

(10) Patent No.: US 7,975,353 B2
(45) Date of Patent: Jul. 12, 2011

(54) DEVICE AND METHOD FOR NEEDLING A NONWOVEN WEB

(75) Inventor: Joachim Leger, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 435 days.

(21) Appl. No.: 12/186,576

(22) Filed: Aug. 6, 2008

(65) Prior Publication Data

US 2009/0038129 A1 Feb. 12, 2009

(30) Foreign Application Priority Data

Aug. 9, 2007 (EP) ..... 07015722

(51) Int. Cl.
*D04H 18/00* (2006.01)

(52) U.S. Cl. ..... 28/107; 28/111

(58) Field of Classification Search ..... 28/107, 28/111, 114, 115, 109, 110, 112, 113; 414/332, 414/426, 402; 242/533.8
See application file for complete search history.

(56) References Cited

U.S. PATENT DOCUMENTS

| | | | | |
|---|---|---|---|---|
| 2,706,056 | A * | 4/1955 | Talley et al. | 414/458 |
| 3,132,406 | A * | 5/1964 | Smith, II | 28/108 |
| 3,574,907 | A * | 4/1971 | Agache et al. | 28/172.1 |
| 3,810,284 | A * | 5/1974 | Brochetti | 28/110 |
| 4,170,676 | A | 10/1979 | Thomas | |
| 5,794,885 | A * | 8/1998 | Husek et al. | 242/533.8 |
| 6,003,215 | A * | 12/1999 | St. Jacques | 28/115 |
| 6,145,176 | A * | 11/2000 | Egnaczak et al. | 28/107 |
| 6,161,269 | A * | 12/2000 | Dilo et al. | 28/114 |
| 6,230,752 | B1 * | 5/2001 | Dornier et al. | 139/1 R |
| 6,994,121 | B2 * | 2/2006 | Burton | 139/7 A |
| 7,117,571 | B2 * | 10/2006 | Dilo | 28/107 |
| 7,194,790 | B2 * | 3/2007 | Leger | 28/114 |
| 7,748,413 | B2 * | 7/2010 | Kojima | 139/21 |

FOREIGN PATENT DOCUMENTS

| | | |
|---|---|---|
| DE | 10 2004 043890 | 4/2006 |
| EP | 1 008 684 | 6/2000 |
| WO | WO 2005/033396 | 4/2005 |

* cited by examiner

*Primary Examiner* — Amy B Vanatta
(74) *Attorney, Agent, or Firm* — Jansson Shupe & Munger Ltd.

(57) ABSTRACT

A device for needling a nonwoven web includes several needle looms arranged in series, each with at least one needle bar, a pair of infeed rollers, and a pair of outfeed rollers. The needle looms can move along a guide in the transport direction of the nonwoven web and can be locked in place at any desired distance from each other.

8 Claims, 3 Drawing Sheets

DEVICE AND METHOD FOR NEEDLING A NONWOVEN WEB

CROSS REFERENCE TO RELATED APPLICATION

This application claims priority based on European patent application EP 07 015 722.7, filed Aug. 9, 2007.

FIELD OF THE INVENTION

The invention pertains to apparatus and methods for needling nonwoven webs and, more specifically, to such apparatus of the type with several needle looms arranged in series for needling a nonwoven web.

DESCRIPTION OF THE PRIOR ART

A device of this type is known from, for example, EP 1 644 565 B1. In this special device, several double needle looms are arranged in series. With this device, it is possible, by adjusting the rate of advance of the nonwoven web and the arrangement of the needles in the various needle boards, to produce various patternings or different stitch patterns. The problem is that, to produce different stitch patterns, the needle boards of the individual needle looms must be replaced.

SUMMARY OF THE INVENTION

It is an object of the present invention to elaborate a device and a method for needling a nonwoven web in such a way that different needle patterns can be produced in a nonwoven web in a flexible and very easy manner.

According to an aspect of the invention, the device for needling a nonwoven web comprises several needle looms arranged in series, each with at least one needle bar, a pair of infeed rollers, and a pair of outfeed rollers. The needle looms can be moved along a guide in the transport direction of the nonwoven web and can be locked in position with respect to each other at any desired distance apart.

In the inventive method for changing the stitch pattern during the needling of a nonwoven web being conducted through several needle looms arranged in series in the transport direction of the nonwoven web, the distance between the needle looms in the transport direction of the nonwoven web along a guide is adjusted, and the needle looms are then locked in place.

To keep costs relatively low while ensuring the high efficiency of the device, each needle loom comprises, in a simple preferred design, two cams with the same eccentricities, the camshafts of which are connected to each other for synchronous movement. The cam followers, which ride on the cams and at least one of which carries at least one needle bar, are connected to each other by at least one movable connecting element.

In an embodiment which is simple to manufacture, the cam followers are designed as an integral unit, and the connecting element is formed by a series of slots in the integral unit extending parallel to each other.

To prevent the camshafts from jamming, the camshafts are arranged next to each other at the same height, and the connecting element between the cam followers is resilient only in the direction perpendicular to the axes of the camshafts in the plane extending between the axes of the camshafts, but is rigid in the direction transverse to that plane, i.e., the connecting element allows the two cam followers to move toward and away from each other horizontally but not up and down with respect to each other.

A simple design of the device is realized by using two rails to form the guide.

Each needle loom can be fastened in place reliably but disconnected at any time by means of a clamping device, which holds the needle loom nonpositively on the rails. Each needle loom preferably stands on wheels, which allow the needle loom to move along the guide, and the device comprises a control unit, which controls stepping motors, which serve to control the movement of the wheels. As a result, the distances between the individual needle looms can be adjusted with extreme accuracy and thus are adapted to the application in question.

BRIEF DESCRIPTION OF THE DRAWINGS

The invention is explained in greater detail below on the basis of the drawings.

DETAILED DESCRIPTION OF THE INVENTION

Figure 1:
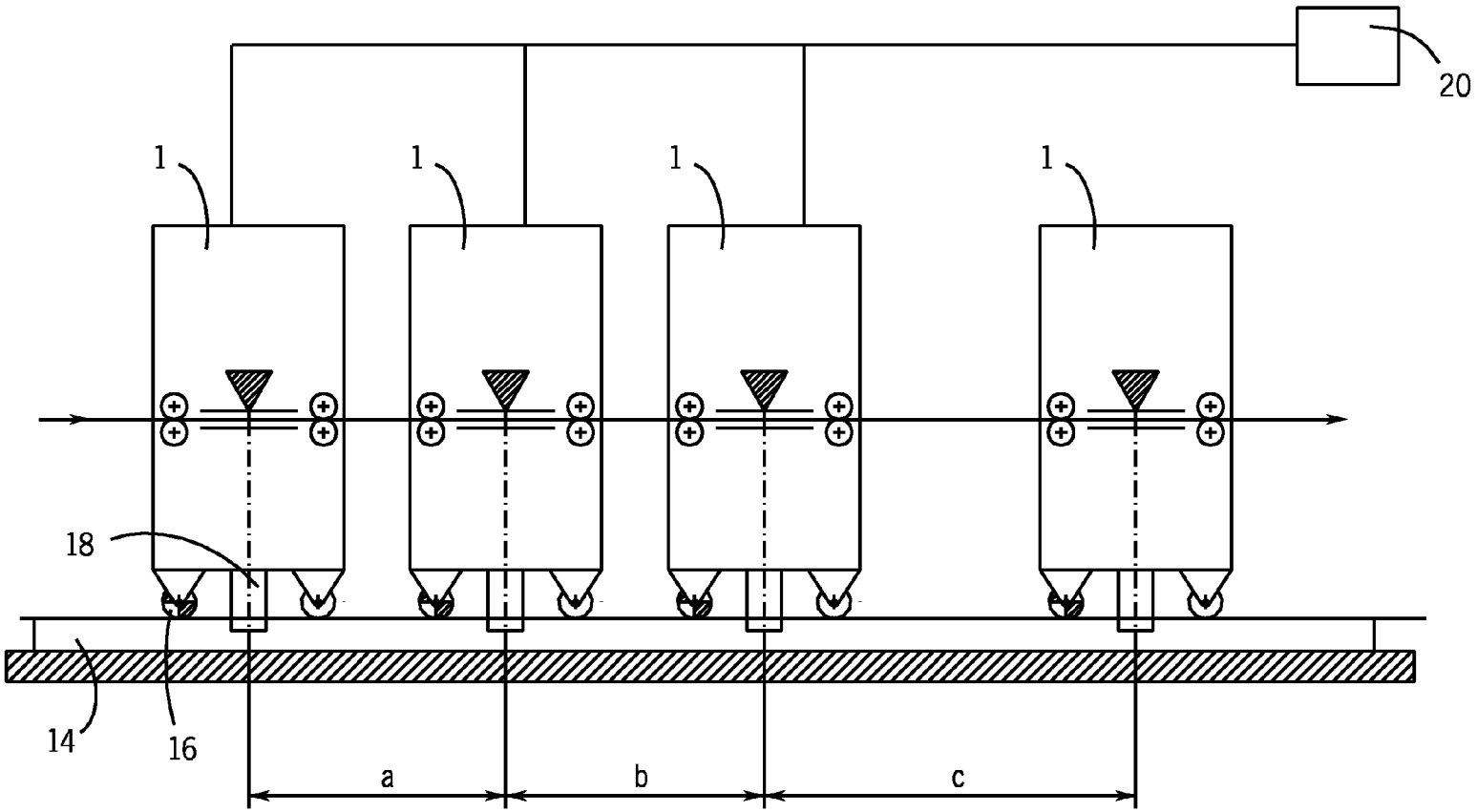
FIG. 1 is a schematic diagram of an example of the inventive device for needling a nonwoven web with several needle looms arranged in series.

FIG. 1 is a schematic diagram of an embodiment of the inventive device with several needle looms 1 arranged in series for needling a nonwoven web. The needle looms 1 are preferably supported on wheels 16, which can roll along a guide 14, which, in the present example, is designed as a set of rails. At least one pair of wheels 16 of each needle loom 1 is driven by a stepping motor, each of which is controlled by a control unit 20. A clamping device 18, which, for example, grips under the upper edge of the rail 14 from the side, serves to lock each needle loom 1 on guide 14. As a result, the distances a, b, c between individual needle looms 1 can be easily adjusted to any desired value. It is also possible for the positions of various needle looms 1 to be adjusted automatically by control unit 20. As a result, the possibility is created of producing various needle patterns in an especially flexible and simple manner. Another special advantage of the design is that it is very easy to maintain and to repair the individual needle looms 1 because the positions of needle looms 1 can be so easily shifted.

Figure 2:
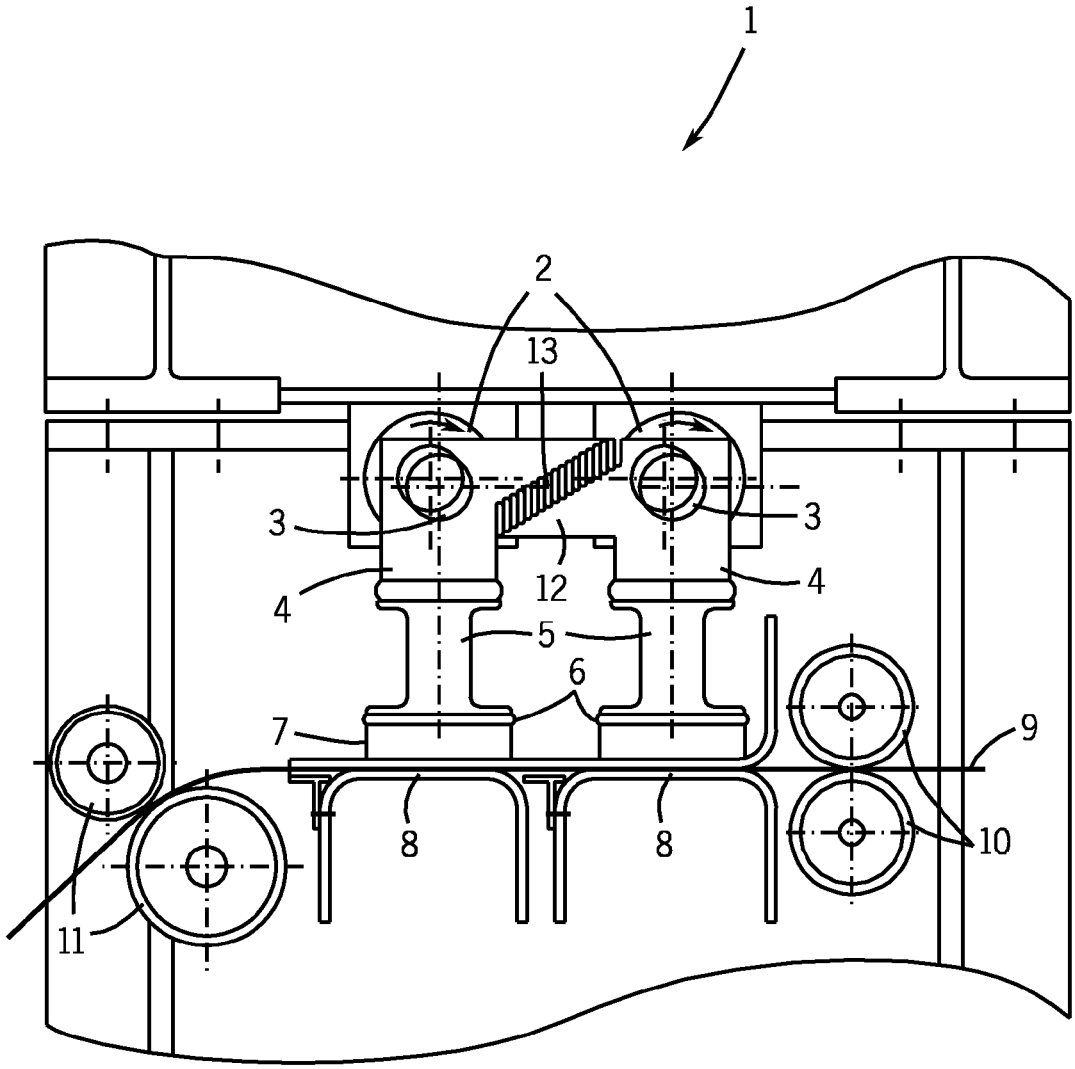
FIG. 2 is a transverse cross-sectional view of a preferred embodiment of a needle loom for use in the inventive device.

FIG. 2 is a cross-sectional view of a preferred needle loom 1 of simple design for use in the inventive device. A machine stand can be seen, at the top of which two camshafts 2 are rotatably supported next to each other at the same height. The shafts are driven in the same direction, as indicated by appropriate arrows. Each camshaft 2 carries a cam 3; the eccentricities of the two cams 3 are the same. A plate-shaped machine element 4 is rotatably supported on each cam 3 and is set in motion by cam 3; these plates are referred to here as "cam followers", and to each of them a needle bar 5 is attached. The two cam followers 4 are designed here as an integral unit. Each needle bar 5 carries a needle board 6, equipped with needles 7.

Stitching plates 8 are mounted in the machine stand 1 underneath the needle boards 6. The nonwoven web 9 to be needled is guided over these plates during operation as it is transported through the needle loom by driven infeed rollers 10 and outfeed rollers 11, which are mounted in the machine stand.

The unit has an extension arm 12, which connects two cam followers 4, and in which a plurality of essentially parallel slots are arranged, which are parallel to the vertical stroke, i.e., the stroke which cams 3 cause cam followers 4 to execute. This plurality of slots forms an elastic connecting element 13 inside extension arm 12, this element thus being resilient in the plane defined by the axes of camshafts 2 but being rigid in the plane perpendicular to that. Two cam followers 4 are therefore able to move essentially in the horizontal direction with respect to each other, as a result of which no jamming can occur at the bearings of camshafts 2. In the vertical direction, any jamming of the bearings can be prevented through the ability of the twin arrangement, which is formed by two cam followers 4 connected by the elastic connection at the connecting element 13, to tip slightly. The slots, which form connecting element 13, can be easily produced by milling or sawing the plate forming cam followers 4.

During operation, the rotation of camshafts 2 causes cams 3 to rotate in phase with each other. Because cam followers 4 are connected to each other by extension arm 12 and connecting element 13, two cam followers 4 follow the rotational movement of cams 3 in congruent fashion, so that the tips of the needles 7 describe a circular path lying in the plane of the drawing. As they traverse this path, they are pushed into nonwoven 9 to be needled by the component of the motion of cam 3 directed toward the left in the drawing, and they are then drawn back out of nonwoven 9 during the component of the cam's motion directed toward the right.

Thanks to the movable connecting element 13, needles 7 will always be thrust properly into nonwoven 9 to be needled from above without tilting during these movements. Because of the movable connection, no jamming can occur at camshafts 2.

Any other conceivable type of needle loom 1 can also be used as long as it guarantees the forward feed of the web. Double needle looms can be used, for example, in which at least one needling unit consisting of a needle-equipped board, a needle bar, and the associated drive device is mounted in the machine stand both above and below nonwoven 9.

Figure 3A:
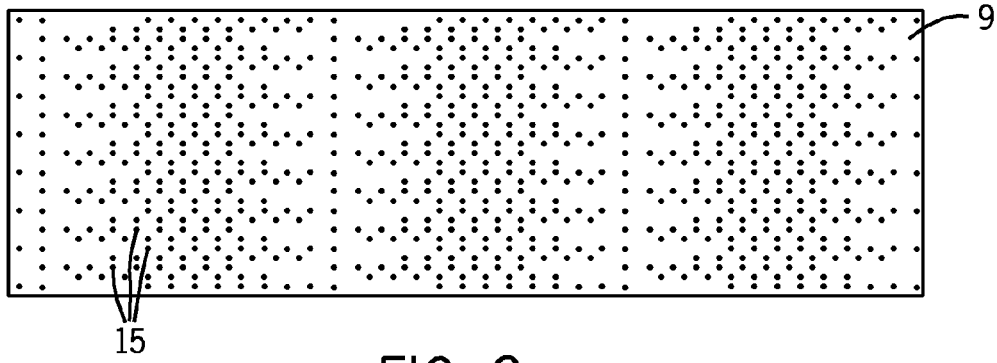
FIG. 3 shows examples of needle patterns, which can be produced by the inventive device.
Figure 3B:
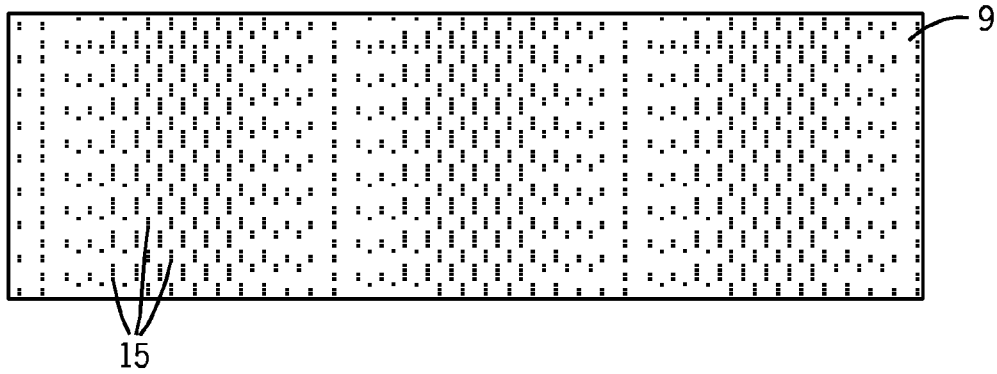
Figure 3C:
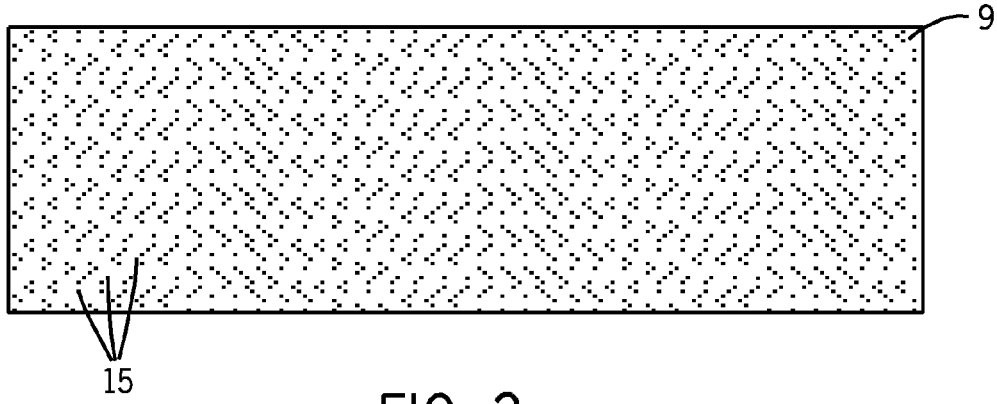

FIG. 3 shows examples of simple needle patterns with stitches 15, which can be produced by the inventive device. FIG. 3*a* is an example of a needle pattern which was produced by passage through one needle loom 1. FIGS. 3*b* and 3*c* show needle patterns which can be obtained by sending the web of FIG. 3*a* through a second needle loom 1. It is easy to see the different patterns of stitches in nonwoven web 9. In the example shown here, the feed rate was 45 mm per vertical stroke of the needle loom; the stitch density in the case of FIG. 3*a* is approximately 13 stitches per $cm^2$, whereas, in FIGS. 3*b* and 3*c*, it is approximately 26 stitches per $cm^2$.

The invention claimed is:

1. A device for needling a nonwoven web comprising:

a plurality of needle looms arranged in series in a transport direction of the nonwoven web; and a guide;

each of the needle looms having at least one needle bar, a pair of infeed rollers, and a pair of outfeed rollers; wherein the needle looms are movable along the guide in the transport direction of the nonwoven web and are lockable in place at any desired distance from each other, each needle loom standing on wheels, which allow each needle loom to move along the guide.

2. The device of claim 1 wherein each needle loom comprises two cams with the same eccentricities each cam having a camshaft and a cam follower, the camshafts are connected to each other for synchronous motion, with the cam followers, riding on the cams and at least one cam follower carrying at least one needle bar, the cam followers being connected to each other by at least one movable connecting element.

3. The device of claim 2 wherein the cam followers are designed as an integral unit, and wherein the connecting element is formed by a series of parallel slots in the integral unit.

4. The device of claim 2 wherein the camshafts are mounted next to each other at the same height, and wherein the connecting element between the cam followers is resilient only in the direction perpendicular to the axes of the camshafts in the plane extending between the axes of the camshafts, but is rigid in the direction transverse to that plane.

5. The device of claim 1 wherein the guide is formed by two rails.

6. The device of claim 5 wherein each needle loom comprises a clamping device, which locks the needle loom nonpositively or positively in place on the rails.

7. The device of claim 1 including a control unit and at least one stepping motor, the control unit driving the stepping motors to control the movement of the wheels.

8. A method for changing the stitch pattern during the needling of a nonwoven web, comprising the steps of:

providing a plurality of needle looms arranged in series in a transport direction of the nonwoven web, the needle looms standing on wheels;

providing a guide for the wheels;

adjusting the distances of the needle looms from each other by moving the needle looms along the guide in the transport direction of the nonwoven web; and locking the needle looms in place.

* * * * *